US008739698B2

(12) United States Patent
Salazar et al.

(10) Patent No.: US 8,739,698 B2
(45) Date of Patent: Jun. 3, 2014

(54) METHOD AND APPARATUS FOR PRINTING ON SOFT GELATIN CAPSULES DURING FORMING

(75) Inventors: Carlos Salazar, Barranquilla (CO); Juan Pablo Manotas, Barranquilla (CO); Luis Guillermo Velasquez, Barranquilla (CO)

(73) Assignee: Procaps S.A., Barranquilla (CO)

( * ) Notice: Subject to any disclaimer, the term of this patent is extended or adjusted under 35 U.S.C. 154(b) by 694 days.

(21) Appl. No.: 12/674,809

(22) PCT Filed: Jul. 30, 2007 (Under 37 CFR 1.47)

(86) PCT No.: PCT/IB2007/002271

§ 371 (c)(1), (2), (4) Date: Nov. 30, 2010

(87) PCT Pub. No.: WO2009/024828

PCT Pub. Date: Feb. 26, 2009

(65) Prior Publication Data

US 2012/0247353 A1 Oct. 4, 2012

(51) Int. Cl.

| | |
|---|---|
| ***B41F 17/36*** | (2006.01) |
| ***B41F 19/08*** | (2006.01) |
| ***A61J 3/07*** | (2006.01) |
| ***B65B 47/00*** | (2006.01) |

(52) U.S. Cl.

CPC ..... *B41F 19/08* (2013.01); *A61J 3/077* (2013.01); *B41F 17/36* (2013.01)

USPC ..... 101/36; 53/454; 53/452; 53/453; 101/37

(58) Field of Classification Search

CPC ..... B41F 17/36; B41F 16/00; A61J 3/07; A61J 3/077; A61J 3/007

USPC ..... 101/33, 34, 35, 36, 37, 38.1; 53/131.2, 53/131.4, 411, 454, 560; 493/143, 144, 493/145, 320, 321

See application file for complete search history.

(56) References Cited

U.S. PATENT DOCUMENTS 2,334,600 A * 11/1943 Boysen ..... 222/107
2,497,212 A * 2/1950 Donofrio ..... 53/443

(Continued)

FOREIGN PATENT DOCUMENTS

EP 1028058 A1 * 8/2000 ..... B65B 61/02
JP 564875 A 3/1993

(Continued)

OTHER PUBLICATIONS

Machine Translation of Ono et al. (JP 05064875; published Mar. 19, 1993).*

*Primary Examiner* — Ren Yan
*Assistant Examiner* — Quang X Nguyen
(74) *Attorney, Agent, or Firm* — Porzio, Bromberg & Newman, P.C.

(57) ABSTRACT

The invention relates to a method and apparatus for printing on the surface of soft gelatin capsules during filling. In particular, the invention relates to an apparatus and method for printing a pre-determined figure or symbol on the surface of a soft gelatin capsule while a product is being encapsulated, including means for transporting the gelatin ribbon, inking means and means for shaping the soft capsule, including an injection, molding and die-cutting station and additional printing means.

7 Claims, 1 Drawing Sheet

(56) References Cited

U.S. PATENT DOCUMENTS

| | | | | | |
|---|---|---|---|---|---|
| 2,811,744 | A | * | 11/1957 | Baldanza | 264/153 |
| 3,038,282 | A | * | 6/1962 | Hansen et al. | 53/454 |
| 3,333,031 | A | * | 7/1967 | Vincent, Jr. et al. | 264/15 |
| 3,661,282 | A | * | 5/1972 | Buhayar et al. | 414/800 |
| 3,682,296 | A | * | 8/1972 | Buhayar et al. | 198/377.08 |
| 3,889,591 | A | * | 6/1975 | Noguchi | 101/37 |
| 4,266,478 | A | * | 5/1981 | Ackley | 101/40 |
| 4,369,157 | A | * | 1/1983 | Conner | 264/246 |
| 4,369,702 | A | * | 1/1983 | Ackley | 101/40 |
| 4,377,971 | A | * | 3/1983 | Ackley | 101/40 |
| 4,501,714 | A | * | 2/1985 | Strobel et al. | 264/245 |
| 4,567,714 | A | * | 2/1986 | Chasman | 53/438 |
| 4,639,341 | A | * | 1/1987 | Hanamoto et al. | 264/40.1 |
| 4,817,367 | A | * | 4/1989 | Ishikawa et al. | 53/454 |
| 4,838,776 | A | * | 6/1989 | Hasl | 425/112 |
| 4,853,169 | A | * | 8/1989 | Kaminski | 264/509 |
| 4,861,541 | A | * | 8/1989 | Kaminski et al. | 264/509 |
| 5,034,166 | A | * | 7/1991 | Rawlings et al. | 264/1.7 |
| 5,082,435 | A | * | 1/1992 | Kuramitsu et al. | 425/117 |
| 5,146,730 | A | * | 9/1992 | Sadek et al. | 53/454 |
| 5,169,653 | A | * | 12/1992 | Tate et al. | 425/503 |
| 5,344,305 | A | * | 9/1994 | McKillip | 425/503 |
| 5,422,160 | A | * | 6/1995 | Ratko et al. | 428/141 |
| 5,707,472 | A | * | 1/1998 | Smith | 156/240 |
| 5,761,886 | A | * | 6/1998 | Parkhideh | 53/454 |
| 5,943,957 | A | * | 8/1999 | Mason | 101/483 |
| 6,286,421 | B1 | * | 9/2001 | Ackley | 101/38.1 |
| 6,402,496 | B2 | * | 6/2002 | Ishikawa et al. | 425/116 |
| 6,450,089 | B2 | * | 9/2002 | Ackley | 101/38.1 |
| 6,481,347 | B2 | * | 11/2002 | Ackley | 101/38.1 |
| 6,769,226 | B2 | * | 8/2004 | Holland et al. | 53/411 |
| 6,990,723 | B1 | * | 1/2006 | Hoogland | 29/527.1 |
| 7,213,511 | B2 | * | 5/2007 | Cruttenden et al. | 101/40 |
| 8,038,432 | B2 | * | 10/2011 | Mazzarolo | 425/388 |
| 2002/0026772 | A1 | * | 3/2002 | Holland et al. | 53/454 |
| 2003/0006536 | A1 | * | 1/2003 | Dunlap et al. | 264/509 |
| 2003/0056667 | A1 | * | 3/2003 | Cruttenden et al. | 101/219 |
| 2005/0051920 | A1 | * | 3/2005 | Thomson | 264/40.1 |
| 2006/0065138 | A1 | * | 3/2006 | Tucker et al. | 101/41 |
| 2007/0119124 | A1 | * | 5/2007 | Barthel et al. | 53/453 |
| 2008/0131593 | A1 | * | 6/2008 | Powell et al. | 427/133 |
| 2008/0260996 | A1 | * | 10/2008 | Heilman et al. | 428/141 |
| 2008/0307753 | A1 | * | 12/2008 | Kessel | 53/454 |
| 2009/0026221 | A1 | * | 1/2009 | Fernandez De Mendiola Quintana | 222/107 |
| 2010/0294147 | A1 | * | 11/2010 | Loiret-Bernal et al. | 101/41 |

FOREIGN PATENT DOCUMENTS

| | | | | | |
|---|---|---|---|---|---|
| JP | 2011120619 | A | * | 6/2011 | |
| WO | 9734806 | A1 | | 9/1997 | |
| WO | WO 9734806 | A1 | * | 9/1997 | B65B 61/02 |
| WO | 9735537 | A1 | | 10/1997 | |
| WO | 03089302 | A1 | | 10/2003 | |

* cited by examiner

METHOD AND APPARATUS FOR PRINTING ON SOFT GELATIN CAPSULES DURING FORMING

CROSS REFERENCE TO RELATED APPLICATION

This is a National Stage of International Application No. PCT/IB2007/002271, filed 30 Jul. 2007 the disclosure of which Application is incorporated by reference herein.

The present invention relates to printing on the surface of soft gelatin capsules during filling. In particular, the invention relates to an apparatus and method for printing a pre-determined figure or symbol on the surface of a soft gelatin capsule while the product is being encapsulated, including means for transporting the gelatin ribbon; inking means; and means for shaping the soft capsule, including an injection, casting, and die-cutting station, and additional printing means. The present invention meets these needs and provides for some other related advantages.

FIELD OF THE INVENTION

The present invention relates to printing on the surface of soft gelatin capsules, so that, while the capsule is being filled with product by injection and subsequently expanded, the surface of the soft gelatin capsule contacts the inner wall of the cast, which has been prepared with printing figures or signs and previously inked, for the surface area of the soft gelatin capsule to be printed with the predetermined figures or signs.

BACKGROUND OF THE INVENTION

During the encapsulation technique the gelatin ribbon is typically pulled out from two sources into a product-loading station where the ribbons are thermally sealed with each other to isolate the product in between them, so that, as they swell up the product becomes trapped between the cavities formed by the roller casts facing each other, wherein the casts further comprise a die-like cutting rim that cuts out the excess gelatin and form the capsule. The gelatin excess is cut out by the interaction of two cutting rims of each one of the casts on the rollers.

As such, gelatin capsules are normally prepared using flexible and deformable gelatin in the form of a ribbon. To obtain the desired effect, gelatin may be mixed with other components to vary its characteristics in different manners for diverse applications, so the term gelatin is used in the present invention to encompass a range of gelatin-based compositions used for encapsulation processes.

Due to this flexibility and deformability, although several methods have been proposed to apply signs or symbols on the gelatin ribbon for them to appear on the resulting capsule, thus far it has been impossible to place specific signs on a gelatin ribbon for them to appear on a pre-determinable manner on the resulting capsule.

There are several alternatives to this gelatin capsule printing issue. The ones used more often involve a printing process wherein one of the gelatin ribbons is previously printed before the process proceeds towards the thermal sealing step.

In fact, US Document, U.S. Pat. No. 2,624,163 granted to Stirn, discloses a system to print colors, stripes, and legends on a gelatin film prior to the formation of gelatin capsules. US Document, U.S. Pat. No. 2,929,320 granted to Hansen et al., discloses a capsule-forming gelatin-film printing system that includes inking means applied prior to capsule formation.

Also, the prior art discloses Great Britain Patent Application GB 9605891 granted to Cruttenden, related to a printing system that prints the gelatin ribbon during transportation, that is, before capsule filling and formation.

All the above documents involve printing on the gelatin ribbon prior to capsule formation, wherein previously inked rollers print the desired symbol or sign on the ribbon. The impression can be appreciated on the surface once the gelatin ribbon is encapsulated and the capsule is formed.

These printing apparatuses and processes are appropriate when the signs or symbols to be printed are sufficiently small with respect to the size of the capsule. Otherwise, during the capsule-formation process, the impressions may overlap with each other, or, in the worst case scenario, the impression may become diffuse as the gelatin ribbon expands during filling and thermal sealing.

There are some other printing systems where the capsule is printed using an inked roller after it has been formed. These systems are unsuitable because the capsule must be positioned in a certain way, snugly fit and ready for a correct printing, this making the process time-consuming, and thus, expensive.

DESCRIPTION OF THE INVENTION

The present invention relates to an apparatus and method for printing a pre-determined figure or symbol on the surface of a soft gelatin capsule while the product is being encapsulated, including means for transporting the gelatin ribbon; inking means; and means for shaping the soft capsule, including an injection, molding, and die-cutting station, and additional printing means from which the capsule exits once it has been formed and printed.

DESCRIPTION OF THE FIGURES

To further clarify the invention and its advantages as compared with the prior art, the potential illustrative and not limitative embodiments of the application of these principles are described hereinafter with the aid of the annexed drawings.

PREFERRED EMBODIMENTS OF THE INVENTION

Figure 1:
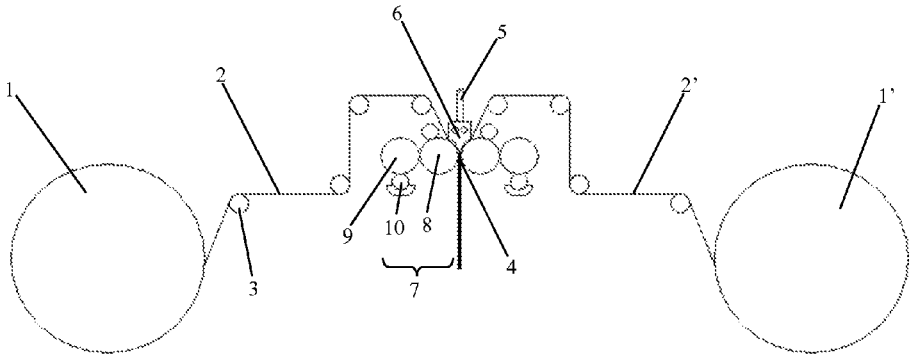
FIG. 1 is a schematic view of the apparatus for printing on soft gelatin capsules during forming, in accordance with the present invention.

The apparatus schematically illustrated in FIG. 1 shows the path of the gelatin ribbons. The first gelatin ribbon 2, and the second gelatin ribbon 2', originate from supply drums 1 and 1'. Each ribbon line is guided by transportation means 3, which comprise the guide rollers, so the ribbon is positioned in the direction of the injection and casting station 4.

At its turn, the injection and casting station 4 comprises filling means 5, and heating means 6.

Normally during the encapsulating process, as the gelatin ribbons swell up they conform to the roller cavity casts facing each other, and then expand due to the action of the product injection, so the capsule is formed with a body with end poles within the cast cavity, where the said cast additionally acts as a die so once the capsule is filled in, the excess gelatin is cut out, and the capsule is finally formed. The form adopted by the capsule as it is filled is due to the action of the injected product and is caused by the stretching allowed by the gelatin. As such, the cast does not influence the form of the capsule as it forms, only its contour as it is cut out.

On the other hand, the main objective of the invention resides on the fact that the injection and casting station 4 itself includes certain printing means 7 set in such a manner that during the conventional process whereby the ribbons are thermally sealed with each other and as they subsequently swell up due to the filling by product injection, the walls of the expanded capsule approach the printing means 7 and the gelatin capsules are printed at the same time. In fact, the subject matter of the present invention is the printing of soft gelatin capsules during forming.

Figure 2:
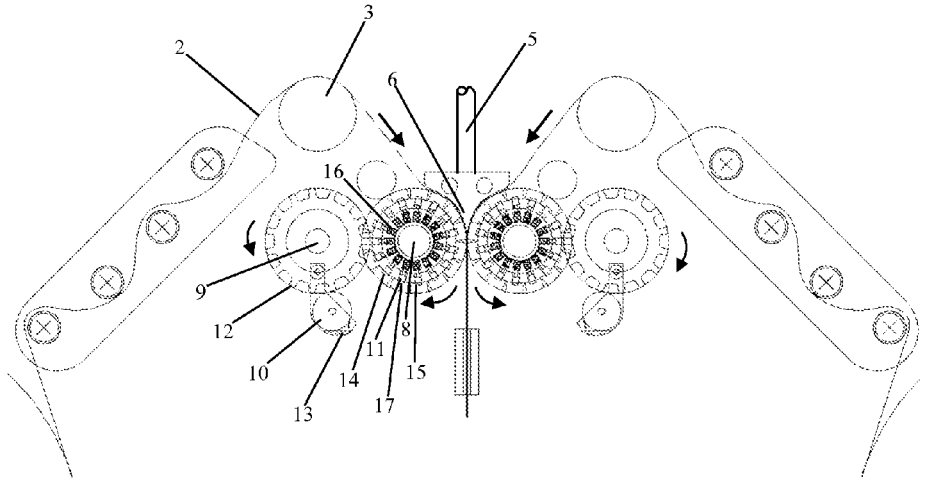
FIG. 2 illustrates in detail the apparatus for printing on soft gelatin capsules during forming, in accordance with the present invention.

For this, the printing means 7 comprise two printing rollers 8 facing each other. The printing rollers 8, juxtaposed to each other, are composed of a plurality of capsule-forming casts and dies 14 (FIG. 2). FIG. 1 illustrates each one of the two gelatin ribbon lines comprising printing means 7. However, as appropriate, it is possible to arrange single printing means in a single gelatin ribbon line, so the capsule may be just printed on one half.

The apparatus of the present invention, in FIGS. 1 and 2, shows that the printing rollers 8, the transfer roller 9 and the ink roller 10, have external and adjacent location, and, are in contact with each other, wherein the ink roller 10 is located adjacent and external regard to the transfer roller 9 and the transfer roller 9 is located adjacent and external regard to the printing roller 8.

The printing rollers 8 are inked by action of the transfer station that comprises each one of the two printing rollers 8, and a transfer roller 9 arranged onto an ink roller 10, which transfers the ink from a reservoir 13 (FIG. 2) before filling.

FIG. 2 illustrates in detail the apparatus for printing on gelatin capsules during forming in accordance with the present invention.

As such, each printing roller 8 comprises a plurality of cavities 11, each forming an encapsulating cast. Each cavity comprises a mouth and a bottom.

The cavities 11 contain the printing arts, while these at their turn comprise a plurality of reliefs that form the sign or figure to be printed.

In a preferred embodiment of the present invention, the printing art may be located at the bottom of the cavity, so that as the capsule expands and makes contact with the art during formation, its pole gets printed. However, in alternative embodiments, the art may be located somewhere between the mouth and the bottom of the cavity.

The cavity formed by the encapsulating cast further comprises a cutting rim 15 to die-stamp the excess gelatin surrounding the expanded and formed capsule when each printing roller 8 is facing the other one.

The cavities 11 of each one of the printing rollers 8 are juxtaposed with a plurality of heads 12 arranged on the surface of a transfer roller 9, so the ink is transferred towards the art located inside each cavity 11 of the printing roller 8.

Thus, the ink roller 10 transfers ink to the heads 12 of the transfer roller 9, to apply ink on the reliefs of the art arranged inside the cavities 11 of the printing roller 8.

The capsule-forming method of the present invention comprises:

(i) A first step wherein the first gelatin ribbon 2 is faced with the second gelatin ribbon 2' inside the injection and casting station;

(ii) In parallel to the first step, during the second step the art reliefs arranged inside the cavities forming the casts of the printing roller 8 are inked by action of the transfer station by the transfer roller 9 arranged onto the ink roller 10.

(iii) A third step wherein the facing ribbons are thermally sealed with each other while they are being filled with the product, so that, as they are swelled up by their content, they conform to the cast cavity, contact the cast cavity and thus, as they contact the art previously inked during the second step, the desired signs or figures are printed on the capsule's surface.

(iv) A fourth step wherein the formed and printed capsule is cut out by the die in the cast-formation rim;

(v) A fifth pre-drying, drying, inspection, and packaging step.

As such, the speed rate of the ink transfer roller 9 is the same as that of the printing roller 8, so no further secondary components are needed for alignment and operation. On the other hand, the ink supply for the ink roller 10 may comprise an ink bath with a recirculation or feeding pump, among other means.

In a preferred embodiment of the invention, the cast cavities may be interchangeable so that the arts conforming the signs or figures may be adapted according to the needs.

Similarly, and on an as needed basis, in order to guarantee the exact fit between the cavity's surface and the art with the heads 12 of the transmitting roller 9 during inking, some spring means 16 used to adjust and compress the art are available.

In a preferred non-limiting embodiment, the art located inside the cavity may form a single piece since in alternative embodiments the art may comprise a separate piece of the cavity, with adjusting means thereto.

What claimed is:

1. An apparatus for printing on soft gelatin capsules during forming, comprising:

printing means joined with an injection and casting station, said printing means comprise two printing rollers facing each other;

said printing rollers are inked by the action of at least one transfer roller, wherein the transfer roller is arranged onto an ink roller that transfers ink from a reservoir;

wherein the printing rollers comprise a plurality of capsule-forming casts and dies juxtaposed to each other;

wherein each capsule-forming cast of the printing roller is formed by a cavity;

wherein said cavities comprise a plurality of printing arts, wherein said printing arts comprise a plurality of reliefs that form signs or figures to be printed;

wherein each cavity of at least one of the printing rollers is juxtaposed with a plurality of heads arranged on the surface of the transfer roller;

wherein the ink is transferred to the printing art located at the bottom of each cavity of the at least one of the printing rollers; and wherein the ink roller is adjacent to and externally located relative to the transfer roller and said transfer roller is adjacent to and externally located relative to the at least one of the printing rollers.

2. The apparatus for printing on soft gelatin capsules of claim 1, wherein each cavity forming the capsule-forming cast further comprises a cutting rim for die and cast the excess gelatin from around the capsule formed when both printing rollers are facing each other.

3. The apparatus for printing on soft gelatin capsules of claim 2, wherein the ink roller transfers ink to the heads of the transfer roller, and wherein the heads of the transfer roller transfer the ink to the printing arts arranged inside the cavities of the printing roller.

4. The apparatus for printing on soft gelatin capsules of claim 3, wherein the transfer roller has the same diameter as that of the printing roller.

5. The apparatus for printing on soft gelatin capsules of claim 1, wherein the cavities are removable and interchangeable so that the printing arts forming signs or figures may be selected as needed.

6. The apparatus for printing on soft gelatin capsules of claim 5, wherein the printing rollers have spring means to adjust and compress the printing arts located inside the cavities.

7. A method for printing on soft gelatin capsules during forming with the apparatus of claim 1, wherein the method comprises:

(i) a first step of providing the apparatus of claim 1;

(ii) a second step wherein the first gelatin ribbon is faced with the second gelatin ribbon at the injection and casting station;

(iii) a third step, in parallel to the first step, wherein the plurality of reliefs arranged inside the cavities that form the casts of the printing roller, are inked at the injection and casting station by the transfer roller arranged onto the ink roller;

(iv) a fourth step wherein the ribbons facing each other are thermally sealed to each other while being filled with a product so that said ribbons are swelled up and conform to the cavities, contact the printing arts that have been previously inked in the third step, and thus forming the capsules having the signs or figures;

(v) a fifth step wherein the capsules formed and printed are cut out by cutting rims of the dies; and (vi) a sixth step of pre-drying, drying, inspecting and packaging the capsules.

* * * * *